US007066786B2

(12) United States Patent
Fujishima et al.

(10) Patent No.: US 7,066,786 B2
(45) Date of Patent: Jun. 27, 2006

(54) METHOD OF DRESSING POLISHING PAD AND POLISHING APPARATUS

(75) Inventors: Tatsuya Fujishima, Gunma (JP); Katsumi Sameshima, Kyoto (JP)

(73) Assignees: Sanyo Electric Co., Ltd., Osaka (JP); Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/941,083

(22) Filed: Sep. 15, 2004

(65) Prior Publication Data

US 2005/0090185 A1 Apr. 28, 2005

(30) Foreign Application Priority Data

Sep. 17, 2003 (JP) ..... 2003-324898

(51) Int. Cl.
*B24B 53/00* (2006.01)

(52) U.S. Cl. ..... 451/5; 451/56

(58) Field of Classification Search ..... 451/6, 451/5, 21, 443, 444, 72, 56
See application file for complete search history.

(56) References Cited

U.S. PATENT DOCUMENTS 5,618,447 A * 4/1997 Sandhu ..... 438/14
5,708,506 A * 1/1998 Birang ..... 356/600
5,951,370 A 9/1999 Cesna
6,093,080 A * 7/2000 Inaba et al. ..... 451/5
6,126,511 A * 10/2000 Hayakawa et al. ..... 451/6
6,186,864 B1 * 2/2001 Fisher et al. ..... 451/6
2001/0012749 A1 8/2001 Oguri et al.
2001/0015801 A1 8/2001 Hirose et al.

FOREIGN PATENT DOCUMENTS

EP 0829327 A1 3/1998
EP 1063056 A2 12/2000
JP 11-070468 3/1999
JP 2003-100683 4/2003
JP 2003-151934 5/2003

OTHER PUBLICATIONS

European Search Report dated Apr. 1, 2005, directed to counterpart European application.

* cited by examiner

*Primary Examiner*—Robert A. Rose
(74) *Attorney, Agent, or Firm*—Morrison & Foerster LLP

(57) ABSTRACT

A method to quantitatively detect an optimum endpoint of dressing of a polishing pad with a non-destructive monitoring of a surface of the polishing pad is offered. The polishing pad is dressed for a predetermined period, and roughness of the surface of the polishing pad is measured with an optical measurement device made of a laser focus displacement meter. Then a characteristic curve representing a correlation between surface roughness of the polishing pad and dressing time is obtained. A gradient of the surface roughness versus dressing time characteristic curve is obtained. Dressing is stopped when the gradient reaches a predetermined value of gradient. These steps are repeated until the gradient of the surface roughness versus dressing time characteristic curve reaches the predetermined value of gradient.

9 Claims, 4 Drawing Sheets

METHOD OF DRESSING POLISHING PAD AND POLISHING APPARATUS

CROSS-REFERENCE OF THE INVENTION

This invention is based on Japanese Patent Application No. 2003-324898, the content of which is incorporated herein by reference in its entirety.

BACKGROUND OF THE INVENTION

1. Field of the Invention

This invention relates to a dressing method of a polishing pad used in CMP (Chemical Mechanical Polishing) and apparatus designed for such a method, specifically to a detection method of an endpoint of dressing and an apparatus implementing the detection method.

2. Description of the Related Art

The CMP has been known as a polishing technology used in planarization of a semiconductor wafer. The CMP is a polishing method using a slurry of abrasives and chemical solution in order to avoid damage to the wafer due to mechanical polishing.

A wafer is polished in CMP by rotating a polishing table with a polishing pad mounted on it and rotating the wafer while pressing the wafer to the polishing pad.

As the number of wafers polished increases, it becomes increasingly difficult for the polishing pad to hold the abrasives on it, because projections and depressions on a surface of the polishing pad decrease and polishing debris goes into the projections and depressions. As a result, the polishing rate in polishing the next wafer is reduced, leading to deterioration in uniformity of a surface of the wafer.

Thus, a dressing is applied to the polishing pad in order to recover the projections and depressions on the surface of the polishing pad to a predetermined roughness. Dressing is performed by rotating the polishing table with the polishing pad mounted on it and rotating a dresser having abrasive grains of diamond while pressing the dresser to the polishing pad. The dressing is used to be performed longer than the minimum time necessary to regenerate the projections and depressions on the surface of the polishing pad in order to avoid insufficient dressing. Applying such excessive dressing has made the life of the polishing pad shorter than expected.

In order to avoid excessive dressing, an optimum endpoint of the dressing has been determined by monitoring the surface conditions of the polishing pad.

Some methods to monitor the surface of the polishing pad are described below, for example. One method is contact type surface displacement measurement. This measurement is performed by touching the surface of the polishing pad by a contact sensor capable of detecting the projections and depressions on the surface of the polishing pad. Another method is a destructive inspection performed by cutting a portion of the polishing pad. In the destructive inspection, a surface condition of the cut-out portion of the polishing pad is inspected with a SEM (Scanning Electron Microscope) or the like.

Further details may be found in Japanese patent No. 2851839 and Japanese Patent Application Publication No. 2003-100683.

In the conventional contact type surface displacement measurement of the polishing pad, however, there is a problem that the surface of the polishing pad is damaged. Also, with the destructive inspection performed by cutting a portion of the polishing pad and inspecting it with SEM, the need for replacing the polishing pad with new one after the inspection increases a cost of dressing and consumes time to replace the polishing pad.

Thus, this invention is made to offer a method to quantitatively detect an optimum endpoint of dressing with non-destructive monitoring of the polishing pad.

SUMMARY OF THE INVENTION

This invention is directed to a dressing method of a polishing pad in which roughness of the surface of the polishing pad is measured with an optical measurement device after dressing the polishing pad for a predetermined period of time (dressing time). This procedure is repeated and the dressing is terminated when a gradient of a characteristic curve of a surface roughness of the polishing pad against the dressing time reaches a predetermined value of gradient.

An apparatus of this invention includes a chemical mechanical polishing equipment including a polishing table, a polishing pad mounted on the polishing table, a dresser to dress the polishing pad, an optical measurement device to measure the roughness of the surface of the polishing pad and a shifter to carry the optical measurement device to a predetermined location on the polishing pad.

DETAILED DESCRIPTION OF THE INVENTION

Figure 1A:
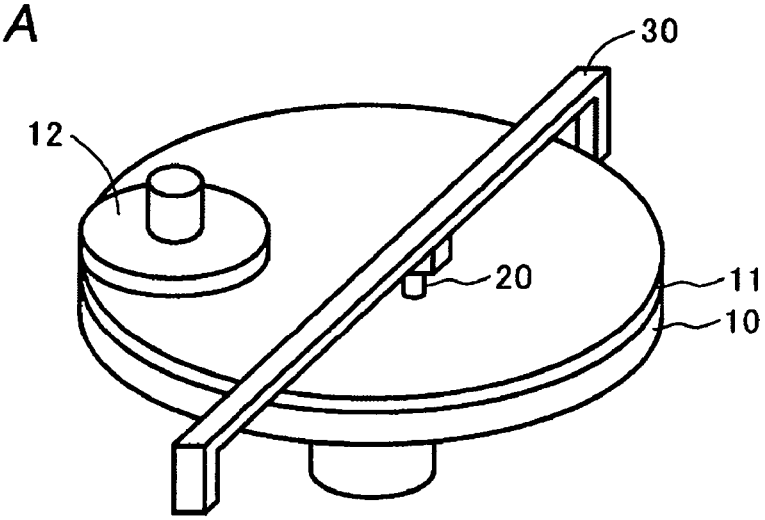
FIGS. 1A and 1B show CMP equipment according to an embodiment of this invention.
Figure 1B:
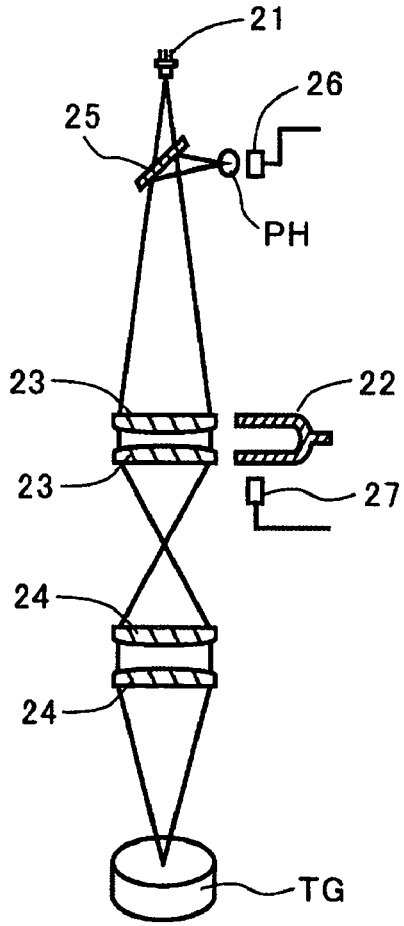

An embodiment of this invention will be described, referring to the drawings. FIGS. 1A and 1B show a structure of CMP equipment according to the embodiment.

FIG. 1A is an outline oblique perspective view of the CMP equipment according to the embodiment. A circular polishing pad 11 is mounted on a rotating polishing table 10, as shown in FIG. 1A. A dresser 12 to dress the polishing pad 11 is provided on the polishing pad 11. A "dressing" is a process to form projections and depressions of predetermined roughness of the surface of the polishing pad 11. The dresser 12 rotates during dressing while it is pressed against the polishing pad 11. The dresser 12 is released from the polishing pad 11 in a period during which dressing is not performed.

And an optical measurement device 20 capable of measuring height of the projections and depressions on the surface of the polishing pad 11 (hereafter referred to as roughness of the surface) is provided over the polishing pad 11. The optical measurement device 20 is mounted on a shifter 30 placed parallel to the surface of the polishing pad 11 and is facing to the polishing pad 11. The shifter 30 can carry the optical measurement device 20 along a subtense (a line connecting two points on a circumference of a circle) on the polishing pad 11. The device 20 can also move in the direction normal to the subtense. For example, the shifter 30 itself moves to a location above a subtense that includes a predetermined portion of the polishing pad 11, and then moves the optical measurement device 20 along a longitudinal direction of the shifter 30 to the predetermined location of the subtense. Or, the shifter 30 may be fixed to a predetermined position and carry the optical measurement device 20 along the longitudinal direction of the shifter 30 to the predetermined location of the subtense. When the shifter 30 is stationary, however, it is necessary to rotate the polishing table 10 over a predetermined range of angle in order that the location of the polishing pad 11 can be measured.

After being carried to the predetermined location on the polishing pad 11, the optical measurement device 20 measures the roughness of the surface while it scans a predetermined small section (hereafter referred to as a scanning section) around the location. The scanning section may be 10 to 20 mm long, for example. However, it is not limited to this distance and may be smaller or larger. The optical measurement device 20 moves in the direction normal to the longitudinal direction of the shifter 30 for example, to make the scanning in the measurement.

In the measurement of the roughness of the surface, the optical measurement device 20 is a laser focus displacement meter, for example. The laser focus displacement meter is a high precision displacement meter using a confocal principle which will be described below. The laser focus displacement meter makes it possible to measure a spot as small as 7 μm. That is, the measurement of the roughness of the surface (height of projections and depressions) is made possible in the embodiment, because the measurement of a spot as small as 7 μm is possible.

Next, a principle of the laser focus displacement meter will be explained referring to a drawing. FIG. 1B shows the principle of the laser focus displacement meter.

In the laser focus displacement meter, a laser beam emitted from a laser beam source 21 (a semiconductor laser, for example) travels through a vibrating lens 23 vibrated by a tuning fork 22 and an objective lens 24 and reaches a target TG, as shown in FIG. 1B. The laser beam reflected by the target TG reaches a pinhole PH through a half mirror 25. When the laser beam focuses on the target TG, the laser beam converges to a point at the pinhole PH. This is called the confocal principle.

When the laser beam converges to the point at the pinhole PH, a light receiving element 26 detects the converged light. And a position detection sensor 27 detects a distance between vibrators of the tuning fork 22 at that moment. Since a position signal detected with the position detection sensor 27 corresponds to a position of the vibrating lens 23, a focal length of the vibrating lens 23 can be found from the position signal. The distance between the laser beam source 21 and the target TG can be found based on the focal length of the vibrating lens 23.

Figure 2A:
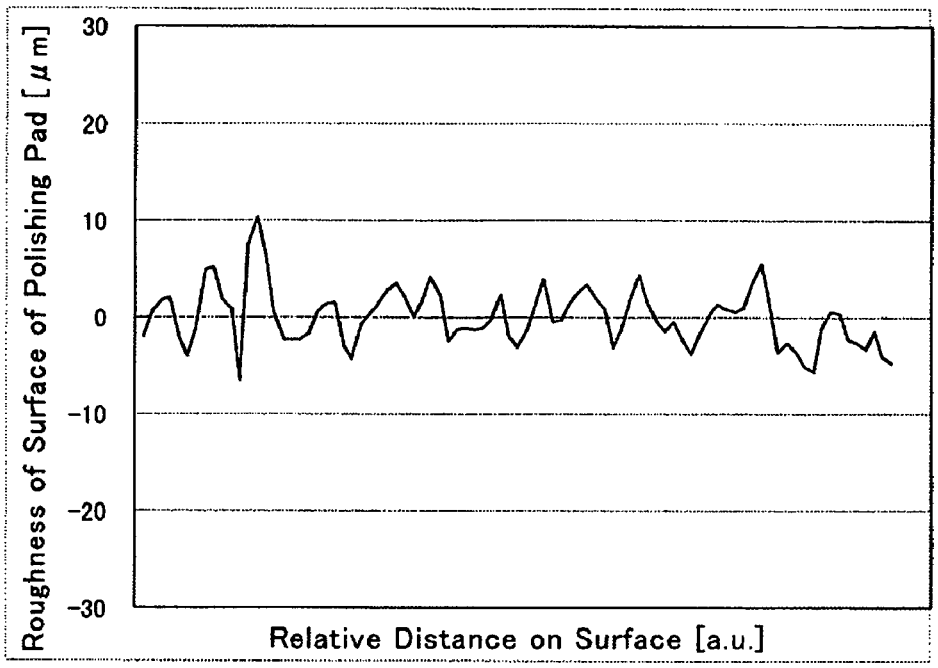
FIGS. 2A and 2B show results of the measurements of roughness of a surface of a portion of a polishing pad before and after dressing using the equipment of FIGS. 1A and 1B.
Figure 2B:
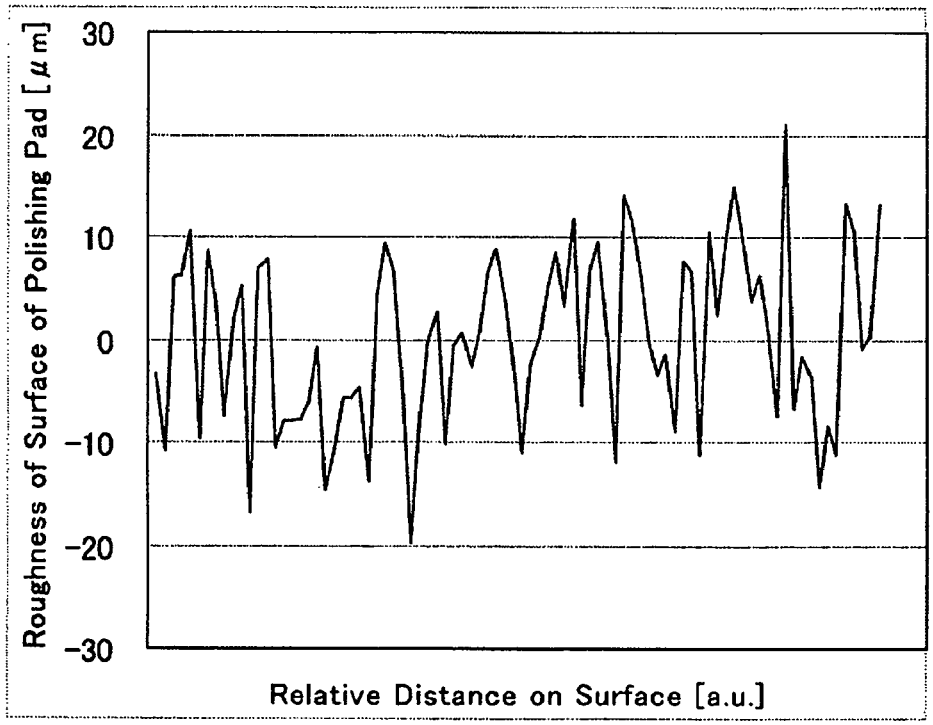

Next, variations in the roughness of the surface of the polishing pad 11 measured with the optical measurement device of FIG. 1B are shown in FIGS. 2A and 2B. FIGS. 2A and 2B are graphs showing the roughness of the surface of a portion of the polishing pad 11 before and after dressing. The horizontal axis of the graphs in FIGS. 2A and 2B corresponds to a relative distance [in arbitrary unit] within the measured spot (scanning section), while a vertical axis of the graphs corresponds to the roughness of the surface [in μm].

FIG. 2A shows the roughness of the surface of the polishing pad before dressing. The surface roughness, which is defined as the difference between the maximum value and the minimum value of the measured surface heights (difference between the maximum height of the projections and the minimum height of the depressions) within the measured spot (the scanning section), is about 17 μm, as shown in FIG. 2A. On the other hand, the surface roughness is about 42 μm, as shown in FIG. 2B. That is to say, the roughness of the surface (height of the projections and depressions on the surface of the polishing pad 11) before and after the dressing can be measured quantitatively by the optical measurement device 20.

Experiments with the apparatus shown in FIGS. 1A and 1B showed that the change in the roughness of the surface measured with the optical measurement device 20 depends on the dressing time at first and becomes almost negligible beyond a certain point of time in the dressing. Next, a correlation between the dressing time and the surface roughness (the maximum variation) will be explained referring to FIG. 3.

Figure 3:
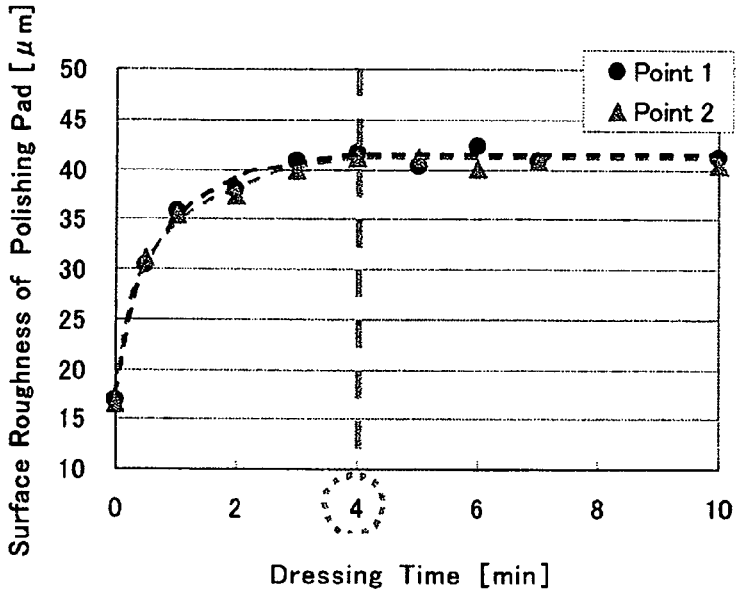
FIG. 3 shows a correlation between the surface roughness and the dressing time.

FIG. 3 shows a correlation between the surface roughness and the dressing time. The horizontal axis of FIG. 3 corresponds to the dressing time [in min.], while the vertical axis corresponds to the surface roughness [in μm]. The roughness of the surface is measured with the optical measurement device 20, as in the case of FIGS. 2A and 2B.

Circular dots plotted in FIG. 3 denote data measured at a point 1 on the polishing pad 11, while triangular dots plotted in FIG. 3 denote data measured at a point 2 on the polishing pad 11 which is different from the point 1. Each curve in FIG. 3 is a characteristic curve obtained from the dots plotted for each set of the points.

As seen from FIG. 3, the surface roughness at each point increases until the dressing time reaches 4 minutes. On the other hand, the surface roughness does not practically change beyond the 4 minute point and remains almost a constant value. The dressing should be stopped when the surface roughness reaches this value, since the surface roughness does not change for further continuation of the dressing. That is, the dressing time at which the surface roughness reaches this saturation (4 min. in this experiment) can make an optimum endpoint of dressing.

It is also found according to the experiments that the etch rate and uniformity within the surface of the wafer (hereafter referred to as surface uniformity) in polishing the wafer using the polishing pad 11 dressed for the dressing time shown in FIG. 3 correspond to the change in the surface roughness shown in FIG. 3. Next, the correlations between the dressing time and the polishing rate or the surface uniformity will be explained referring to FIG. 4.

Figure 4:
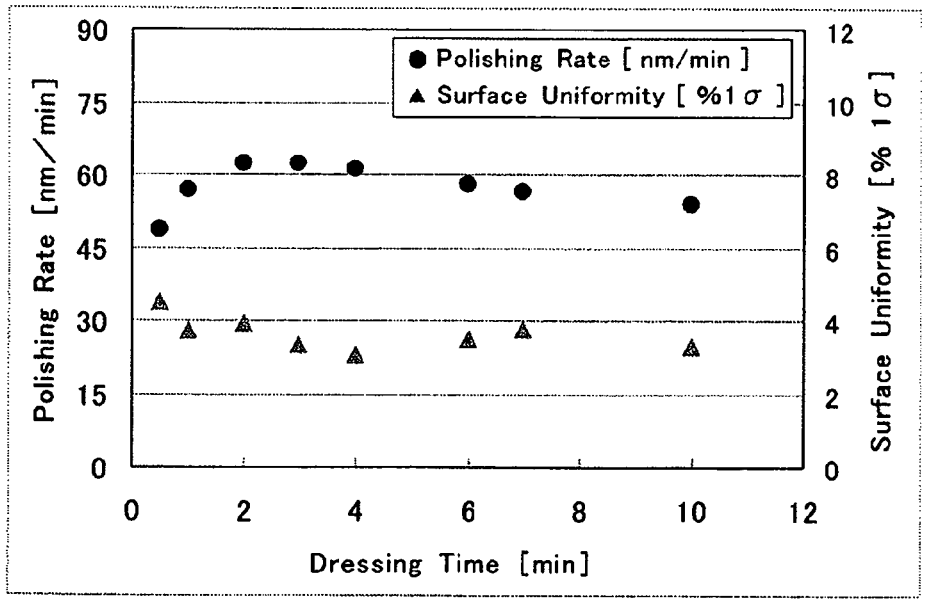
FIG. 4 shows correlations between characteristics in polishing a semiconductor wafer (polishing rate and uniformity within a surface of the wafer) and the dressing time.

FIG. 4 shows the correlations between the dressing time and the characteristics (the polishing rate and the surface uniformity) in polishing the wafer using the polishing pad 11 dressed for a corresponding dressing time. The horizontal axis of FIG. 4 corresponds to the dressing time [in min.]. The left vertical axis of FIG. 4 corresponds to the polishing rate [in nm/min] in polishing the wafer using the polishing pad 11 as a function of the dressing time. And the right vertical axis of FIG. 4 corresponds to the surface uniformity [% (one sigma)] within the wafer. The wafer polished with the polishing pad 11 in this experiment includes P-TEOS (plasma TEOS).

As seen from FIG. 4, the polishing rate and the surface uniformity in polishing the wafer vary as a function of the dressing time (time taken for dressing the polishing pad 11 after polishing the wafer). The changes in both characteristics are large up to 4 minute dressing time, and becomes less pronounced beyond the 4 minute point.

Figure 5:
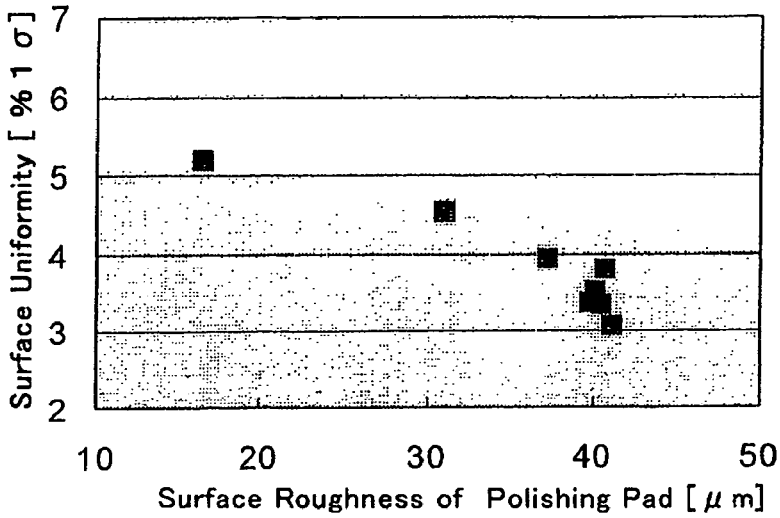
FIG. 5 shows a correlation between the uniformity within the surface of the wafer and the surface roughness.

There is also a correlation between the surface roughness of the polishing pad 11 and the surface uniformity from measurement results shown in FIG. 4. FIG. 5 shows this correlation between the surface uniformity and the surface roughness. The horizontal axis of FIG. 5 corresponds to the surface roughness [in μm], while the vertical axis corresponds to the surface uniformity [% (one sigma)].

As shown in FIG. 5, the surface uniformity of the wafer polished with the polishing pad 11 converges around 3 to 4% (one sigma) for 42 μm of the surface roughness, which is the surface roughness at the saturation (Refer to FIG. 3.).

The optimum endpoint of dressing can be found by measuring the surface roughness of the polishing pad 11 and studying the results, as explained above. Since the dressing time corresponds to the change in the characteristics (the polishing rate and the surface uniformity) in polishing the wafer, polishing the wafer with desired characteristics (the polishing rate and the surface uniformity) is also possible.

Figure 6:
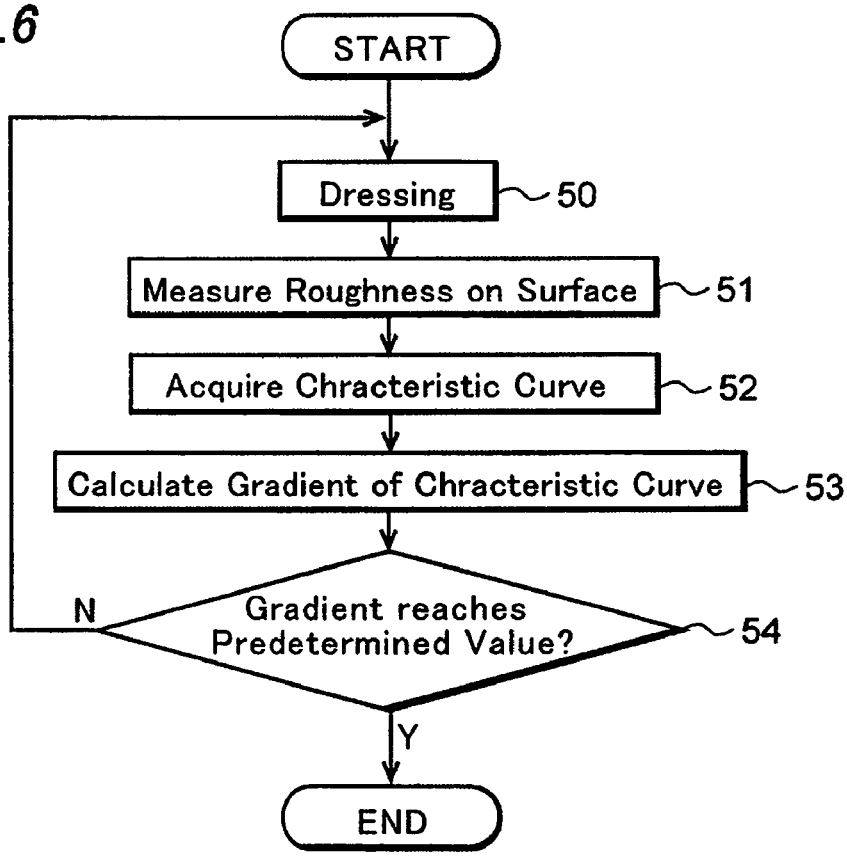
FIG. 6 is a flow chart showing a method to detect an endpoint of dressing.

Next, a procedure to detect the optimum endpoint of dressing described above will be explained referring to a flow chart. FIG. 6 is the flow chart showing the method to detect the optimum endpoint of dressing. Dressing 50 shown in FIG. 6 denotes dressing made after the polishing pad 11 is mounted on the polishing table 10 for the first time or dressing made after polishing of a wafer is completed.

The detection of the optimum endpoint of dressing takes following steps as shown in FIG. 6.

First, the polishing pad 11 is dressed for a predetermined time (1 min. for example) in step 50.

After dressing in step 50 is finished, the roughness of the surface of the polishing pad 11 is measured with the optical measurement device 20 shown in FIG. 1B in step 51. Here, the measurement of the roughness of the surface is made at a predetermined location or at a plurality of predetermined locations on the polishing pad 11. The optical measurement device 20 is moved to the predetermined location or locations by a predetermined action of the shifter 30. The measurement is carried out in one scanning section at each of the predetermined locations and the surface roughness as defined above is measured at the location.

Next in step 52, the characteristic curve, which may be a straight line, is obtained by plotting the surface roughness as a function of the dressing time. Here, the increment in the dressing time is the same length of time as the predetermined time in step 50.

Next, a gradient of the surface roughness as a function of the dressing time obtained in step 52 is determined. The gradient is determined by differentiating the characteristic curve with respect to the dressing time, for example. However, the method to determine the gradient of the characteristic curve is not limited to this. Other methods to determine the gradient of the characteristic curve may be used instead. For example, a gradient of a line segment connecting two points on the characteristic curve may be used as the gradient of the characteristic curve.

Then, whether the gradient of the surface roughness versus dressing time characteristic curve determined in step 53 reaches a predetermined gradient (zero, for example) is judged in step 54. If the gradient determined in step 53 is not equal to or does not surpass the predetermined gradient, the steps 50 through 53 are repeated. On the other hand, if the gradient determined in step 53 is equal to or surpasses the predetermined gradient, the dressing is stopped as further dressing in step 50 is regarded unnecessary. That is, the point in time when the gradient of the characteristic curve coincides with or surpasses the predetermined gradient is the endpoint of the dressing in this embodiment. Then the next wafer is processed in a next process step which is not shown in the flow chart. Although the predetermined gradient is zero in this embodiment, the predetermined gradient is not limited to zero and may be some other value.

Excess dressing can be avoided with this method to detect the endpoint of dressing using the optical measurement device 20 as described above. As a result, it is made possible to suppress the increase in cost and lost time in dressing, since the shortening of the life of the polishing pad 11 can be suppressed.

Although the laser focus displacement meter is used in the embodiment, this embodiment is not limited to the laser focus displacement meter. That is, the optical measurement device 20 may be other optical measurement device, as long as it can measure the height of the projections and depressions on the polishing pad 11 in a non-destructive manner.

In the embodiment, the shifter 30 can move the optical measurement device 20 along a subtense on the polishing pad 11, and move the device 20 in the direction normal to the subtense. However, this embodiment is not limited to this configuration. That is, the shifter may have other construction and operation as long as it can move the optical measurement device 20 to any location on the polishing pad 11.

The laser focus displacement meter which can measure the height of the projections and depressions on the surface of the polishing pad is used as the optical measurement device in monitoring the status of the polishing pad in the method to detect the endpoint of dressing in this invention. The surface of the polishing pad can be monitored non-destructively with this method.

Since the optimum dressing time can be determined based on the results of measurement of the roughness of the surface, the dressing can be completed in as short period of time as possible. The cost of dressing can be reduced since the life of the polishing pad can be extended with this method.

Furthermore, the number of samples measured can be increased, since the CMP equipment of this embodiment is provided with the optical measurement device capable of measuring the roughness of the surface at any location on the polishing pad. The precision of measurement in monitoring the polishing pad can be enhanced.

What is claimed is:

1. A method of dressing a polishing pad, comprising:

performing a first dressing on the polishing pad;

performing a first measurement of a surface roughness of the polishing pad using an optical device after the first dressing;

performing a second dressing on the polishing pad after the first measurement;

performing a second measurement of the surface roughness of the polishing pad using the optical device after the second dressing; and determining a rate of change in the surface roughness based on the first and second measurements, wherein a third dressing on the polishing pad is performed if the rate of change is larger than a predetermined rate.

2. The method of claim 1, wherein the first and second measurements are performed as the optical device scans at least a portion of the polishing pad.

3. The method of claim 1, wherein the optical device comprises a laser focus displacement meter.

4. The method of claim 2, wherein the optical device comprises a laser focus displacement meter.

5. The method of claim 1, wherein the first and second measurements comprise detecting a maximum height of projecting portions within an area of measurement of the polishing pad and detecting a minimum height of denting portions within the area of measurement.

6. The method of claim 2, wherein the first and second measurements comprise detecting a maximum height of projecting portions within an area of measurement of the polishing pad and detecting a minimum height of denting portions within the area of measurement.

7. The method of claim 3, wherein the first and second measurements comprise detecting a maximum height of projecting portions within an area of measurement of the polishing pad and detecting a minimum height of denting portions within the area of measurement.

8. The method of claim 4, wherein the first and second measurements comprise detecting a maximum height of projecting portions within an area of measurement of the polishing pad and detecting a minimum height of denting portions within the area of measurement.

9. A method of dressing a polishing pad, comprising:

repeating a dressing of the polishing pad for a predetermined period and an optical measurement of a surface roughness of the polishing pad, wherein the repeating is stopped when a rate of change in the measured surface roughness is determined to be smaller than or equal to a predetermined rate.

* * * * *